US005127922A

United States Patent [19]

Bension

[11] Patent Number: 5,127,922

[45] Date of Patent: Jul. 7, 1992

[54] CANDLES WITH COLORED FLAMES

[76] Inventor: Rouvain M. Bension, 310 Summit Ave., Brookline, Mass. 02146

[21] Appl. No.: 407,882

[22] Filed: Sep. 15, 1989

[51] Int. Cl.[5] ..... C10L 5/00

[52] U.S. Cl. ..... 44/275

[58] Field of Search ..... 44/275

[56] References Cited

U.S. PATENT DOCUMENTS

| | | | |
|---|---|---|---|
| 3,183,068 | 5/1965 | Monick | 44/266 |
| 3,266,272 | 8/1966 | Fredricks | 44/275 |
| 3,283,546 | 11/1966 | Matsui | 431/126 |
| 3,630,697 | 12/1971 | Duling | 44/275 |
| 3,871,815 | 3/1975 | Cangardel | 44/275 |

FOREIGN PATENT DOCUMENTS

| | | |
|---|---|---|
| 1226234 | 6/1961 | Fed. Rep. of Germany . |
| 1945120 | 9/1969 | Fed. Rep. of Germany . |
| 2364506 | 12/1973 | Fed. Rep. of Germany . |
| 1058844 | 2/1967 | United Kingdom . |

*Primary Examiner*—Prince Willis, Jr.
*Assistant Examiner*—John F. McNally
*Attorney, Agent, or Firm*—Bucknam & Archer

[57] ABSTRACT

A candle with a colored flame is described, which is free of the yellow color, usually found in the conventional paraffin candle. The candle comprises (1) a shell made of a saturated thermoplastic material and 10–30% of a fire retardant: (2) a fuel consisting of 70–100% of a polyoxymethylene, 0–30% of a binder, and 0–20% of a solvent. The candle also comprises 1–10% of a flame-coloring agent, such as a salt or an oxide of Li, B, Na, Ca, Cu, K, Sr, In, or Ba. The candle does not require a wick.

20 Claims, No Drawings

CANDLES WITH COLORED FLAMES

BACKGROUND OF THE INVENTION

The invention relates to a novel candle formulation that burns with a colored flame free of the yellow color associated with the familiar paraffin candle.

One of the requirements for a candle burning with a true, one-colored flame is removal of the yellow color, found in the common paraffin candle, for example. Briefly, the burning process is thought to involve the following steps: (1) melting of the solid wax by the heat of the flame; (2) migration of the liquid wax toward the flame zone through the wick; (3) vaporization of the liquid wax; (4) incandescence of the wax vapor as it rises into the flame; (5) combustion of the wax vapor to carbon dioxide and water as it mixes with the oxygen of the air that diffuses into the flame. In a gas stove, on the other hand, the fuel, already in the gaseous state, can be pre-mixed with the air required for combustion, and the familiar pale-blue flame thus arises from fragments of molecules that appear and disappear continuously during the combustion of the gas. In fact, the pale blue color can be observed even in the familiar candle flame, in those areas where air can most easily reach, i.e., the outside surface of the bottom part of the flame. In other areas of the flame, the pale blue color is present, but is obscured by the yellow. Therefore, a candle which eliminates the yellow color, leaving only the pale blue, gives a flame of one pure color and constitutes a substantial improvement.

Since the presence of air, or more accurately, oxygen, in the flame zone is the key to elimination of the yellow color, previous attempts have employed four methods: (1) use of a wax or fuel which is made up of molecules containing sufficient numbers of oxygen atoms, e.g., polyethylene glycols; (2) introduction of an additive containing a high proportion of oxygen atoms as an oxidizing agent, such as ethylene carbamate; (3) dispersion of air in the solidifying wax; (4) use of the flame colorant as the fuel as well. All of these attempts have suffered serious disadvantages.

One method uses a fuel that incorporates suitable amounts and distributions of oxygen atoms. German patent 1,226,234, uses polyethylene glycols, polymers with repeating units of three atoms, two carbon and one oxygen, in the polymer chain. Polyethylene glycols of the molecular weight specified in the patent are waxy substances, similar in appearance to paraffin, and require a wick to transport them to the flame, following the combustion mechanism described above. Moreover, according to the patent, the oxygen already present in the fuel (about 36.4% by weight) requires augmentation in order to maintain combustion. The three additives, ethylene glycol, glycerin, and ethyl carbamate, specified in the examples, are added in amounts sufficient to raise the oxygen level to between 38.7% and 39.8%. The patent also recognizes that the molten fuel is more viscous than molten paraffin, and thus flows more slowly up the wick, and recommends the use of an appropriate wick of denser cross section and lesser thickness. However, a denser wick collects more difficultly combustible products, introducing the familiar yellow color into the flame. Indeed, the problems associated with the wicks of ordinary candles have been addressed in subsequent disclosures, either by additives to the wick, or by eliminating it. The above cited patent, therefore, leaves one with the choice of a small flame of pure hue, or a larger flame with a yellow core.

An attempt to improve on the candle of the patent cited above is disclosed in German patent 1,945,120, which reverts to paraffin as the fuel, but emulsifies the fuel with air. However, this candle is difficult to produce. The example provided requires, first, preparation of a flame-coloring agent with three components, the concentrations and cooling of which must be carefully controlled; second, a wick which must be coated with paraffin by repeated dipping; third, application of the flame-coloring agent to the coated wick in a layer applied as strips, the edges of which must not touch, and the total amount of which must be carefully controlled; fourth, an air-paraffin emulsion prepared by inspirating paraffin which must be held precisely at a temperature just under the solidification point (presumably even under the cooling influence of the gas); and finally, immediate transfer of the emulsion into a mold containing the components of the candle already described.

Another proposal, disclosed in German patent 2,364,506, uses a fuel of metaldehyde, a polymer with a repeating unit of two atoms, carbon and oxygen, in the polymer chain and with an additional carbon atom attached to each of the carbon atoms in the main chain. Since the polymer is so much more combustible than polyethylene glycol, it supports a flame directly, without requiring a wick. Consequently, a coating is necessary to control combustion and prevent the flame from spreading down the side of the candle. The patent discloses the use of a metallic stearate mixed with stearin as the coating, serving also as the flame coloring agent. However, the patent discloses further that the coating by itself is not sufficient to control combustion; in the vicinity of the flame, a metal cup-shaped piece, fashioned to exacting specifications, is required to prevent degradation of the coating itself.

The method of production of the candle is not easy, since the material melts to a liquid only in a sealed tube or container, but sublimes directly to the gas when not enclosed. Moreover, the sealed-tube melting point (246° C., 475° F.) is much higher than the sublimation point (which is reported in various sources as 112° C., 234° F. or 193° C., 380° F., the latter being specified in the patent as the melting point). Therefore, any process used for shaping the metaldehyde core of the candle into the specified core of square cross-section would have to employ a sealed tube at high temperatures.

Finally, disclosure of a candle with a fuel consisting exclusively of a metal stearate alleges to eliminate the problems associated with delivery of the coloring agent up the wick, but does not address the problem of the complete elimination of the familiar yellow color.

In view of the problems listed herein, a candle which burns at an acceptable rate, with a sufficiently large flame from which the normal yellow color has been eliminated, preferably without requiring a wick, without dripping or extensive melting, and leaving a minimal, if any, residue, is highly desirable.

SUMMARY OF THE INVENTION

The candle of the invention consists of a fuel composed chiefly of polyoxymethylene (70% to 100%), a binder (0% to 30%) composed of trioxane, and a solvent (0–20%) such as ethylene glycol; a protective shell of a non-charring, saturated thermoplastic, such as polypropylene (70–90%) and a fire-retardant additive (10–30%), such as alumina trihydrate or silicone elastomer; and a flame-coloring agent (1–10%), composed of any of the metal salts or oxides well-known in the art, such as those of lithium, boron, sodium, calcium, copper, potassium, strontium, indium, or barium.

Optional ingredients can also be added: a dye to the shell material, and a scent to the fuel or shell material, to give the candle an attractive appearance and odor.

Such a candle burns with a large and attractive flame of the desired color, from which the interference of the familiar yellow color has been eliminated, with no dripping or melting, and no unpleasant odor.

DESCRIPTION

The inclusion of three components in the candle of the present invention makes it novel: (1) a fuel which burns with a very pale flame, which does not interfere with the intensity or hue imparted to the flame by the coloring agent; (2) a protective shell, which prevents the flame from spreading over the entire surface of the candle, and which may, in addition, protect the fuel from contamination and deterioration; (3) a flame-coloring agent.

Fuels which burn with the palest flames are generally those in which oxygen atoms have been pre-mixed, in a ratio of not more than about two carbon atoms to one oxygen atom along the backbone, or longest chain of atoms in the fuel molecules. In order to obtain a satisfactory rate and cleanliness of combustion, the carbon:oxygen atom ratio should be no more than about 1:1, distributed evenly along the chain. Polymers with such structures are available, known as polyoxymethylenes, represented by the general formula —[CH2O]—n. Even polyoxymethylene copolymers, for example where —[CH2CH2CH2CH2O]—units replace some —[CH2O]—n units, contain enough oxygen atoms throughout the flame zone so that large carbon atom clusters (soot particles) are unable to form between vaporization and complete combustion, and thus to glow yellow. Polyoxymethylenes burn by decomposing under the influence of the flame directly to gas, which easily mixes with the oxygen of the air, and burns cleanly. A finely divided (granulated or powdered) fuel, therefore, is necessary to maintain the rate of decomposition of the fuel into gas. Paraformaldehyde is the most easily powdered polyoxymethylene currently available, easier than the acetal thermoplastics available commercially, and it is far less expensive. For example, Hoechst-Celanese Corporation sells acetal resin under the trade name "Celcon" for a minimum price of $1.64 /lb, but sells paraformaldehyde for a minimum of $0.315 /lb. This grade of paraformaldehyde is manufactured in prilled form, with a specified purity, sealed-tube melting range, and average degree of polymerization, of 91–93%, 110°–160° C., and 14–16 monomer units, respectively. In general, paraformaldehyde is manufactured with a range of purities from 82–97%, and any of these grades can be satisfactorily employed in the fuel disclosed herein. Paraformaldehyde has not been claimed previously as a fuel suitable for candles, perhaps because of the apparent difficulty of fashioning it into a candle.

In order to give the fuel more consistency, allowing better packing, addition of a binder is preferable. Substances suitable for binding the powder or granules of polyoxymethylene are those containing only carbon, hydrogen, and oxygen, with a carbon:oxygen ratio and distribution frequency of no more than 2:1 in the main chain of the molecule, a pH of 7 (to avoid decomposing the paraformaldehyde), and a melting point between 40° C. and 170° C. Examples of suitable binders are trioxane, dimethyl oxalate, and polyethylene glycols with average molecular weight of at least 1450. It should be emphasized that any use of such polyethylene glycols in this invention is only as a binder, and not as the main component of the fuel, as claimed in the patent cited previously, since the fuel of the present invention is more easily combustible than the polyethylene glycols.

It is useful to employ a solvent to spread the binder over the surface of the fuel particles, and a lower alcohol, such as methanol, ethanol, or ethylene glycol is suitable for this purpose, the latter being preferred. The lower polyethylene glycols, with average molecular weight of 400 or less, are also suitable. Again, it is worthwhile to point out that the use of ethylene glycol is only as a solvent, and not as a combustion promoter, as claimed in the previously cited patent; indeed, the fuel of the present invention is more combustible than ethylene glycol, with flash points of 160° F. and 230° F., respectively.

Paraformaldehyde can be employed in the range of 70% to 100% of the total fuel weight, preferably 76% to 80%; the binder from 0% to 30%, preferably 6% to 9%; and the solvent 0% to 20%, preferably 12% to 16%.

Protective shells can be made from suitable thermoplastics containing a fire-retarding agent, of a composition designed to allow degradation of the shell, by melting and/or combustion, at a rate of about 1 inch/15–20 minutes. In general, any non-charring thermoplastic containing only saturated aliphatic groups, except for unsaturated carbon-oxygen bonds, and a limiting oxygen index (LOI) of between about 0.16 and 0.18 is suitable as a base resin, where LOI is defined as the minimum molar concentration of oxygen divided by the sum of the molar concentrations of oxygen and nitrogen (i.e., minimum mole % of oxygen) required to maintain combustion. The saturated polyolefins are preferred as base materials for the protective shell, and polypropylene is most preferred.

Any of the fire retardants well-known in the art (listed, for example, in the Modern Plastics Encyclopedia, among other reference sources) that is applicable to plastics, and added in an amount sufficient to slow the burning rate to 1 inch/15–20 minutes, is suitable. A non-halogenated, inorganic flame retardant is preferred, and alumina trihydrate is most preferred. A silicone elastomer is also preferred; it can be added as a curable silicone liquid to the base resin, followed by its curing agent, and it can be mixed and cured at the same time. Magnesium hydroxide is also preferred, either by itself, or formulated with a treatment allowing its application to the desired plastic material. Finally, magnesium carbonate/calcium carbonate fire retardant, although not falling into one of the categories mentioned thus far, is also applicable.

The fire retardant can be employed in the range of 10% to 30% of the total weight of the shell, preferably 15% to 20%, with the balance the base resin and any flame coloring agent to be included in the shell.

The thickness of the shell also influences its rate of combustion by the candle flame. A thickness of about 0.01 to 0.06 inch is suitable, and for a cylindrical candle shape 12" long × ⅞" diameter, a thickness of about 0.03 inch to 0.04 inch is preferable. The shell thickness may vary as required for other candle diameters and shapes.

The combination of the fuel and the protective shell is such that not only does the fuel burn cleanly, but it burns cleanly enclosed in the shell, and it burns the shell cleanly as well. For these reasons, certain fuel gels that have been disclosed to burn non-luminously form undesirable by-products when included in the candle of the present invention, introducing a significant amount of the familiar yellow color into the flame, and are therefore unsuitable as fuels in this case.

The flame-coloring agent can be any of the metal salts or oxides well-known in the art, such as those of lithium, boron, sodium, calcium, copper, potassium, strontium, indium, or barium, and others, but it is desirable not to use compounds that constitute a health hazard, for example, lead compounds, or indium trichloride, or those capable of an oxidizing or explosive action, for example, the nitrates, chlorates, or perchlorates. On the other hand, organic derivatives of these metals containing only carbon, hydrogen, and/or oxygen, such as their carboxylic acid salts, or acetylacetone complexes, for example, are completely suitable, provided that the only unsaturation in such organic groups is carbon-oxygen. The flame coloring agent can be added either to the fuel, by mixing it in with the other ingredients, or to the shell, by compounding it in the base resin along with the fire retardant, or it can be coated onto the inner surface of the candle shell, either in a heated and softened state, or pre-treated with a tackifier. The flame coloring agent can be employed in the range of 1% to 70% of the shell or fuel weight, depending on the nature and location of the coloring agent. For example, boric acid or cupric chloride produce colors of satisfactory intensity when added to the fuel in concentrations of only a few percent, while the concentration of lithium chloride required in the fuel is so high that a layer builds up on the burning surface, choking the flame. Lithium chloride, therefore, must be added only to the plastic shell, either by coating on the inside surface, or by mixing with the shell material. Since the inside surface is the location of the shell in closest contact with the flame, coating is the more technically efficient use of the flame colorant. However, mixing with the shell material may be the more economically efficient process for manufacturing, subject to the cost of the process chosen and of the flame coloring material. In the case of lithium chloride and colorants behaving similarly, therefore, the concentration of the colorant throughout the shell material must be great enough that a sufficient percent of it becomes distributed at or near the inside surface during formation of the shell. In general, about 10–70%, based on total shell weight, is required.

It may be desirable to add a co-colorant; in the case of a blue flame, for example, the copper colorant must be supplied with a halide (such as chloride ion), or it will impart a green color, rather than a blue one, to the flame. Thus, the blue-flame colorant can be either cupric chloride, or another copper compound less prone to decomposition, such as the oxide or carbonate, employed with a co-colorant. In the case of other colorants, halides can increase the intensity of the flame color, if the metal compound does not already contain them. Ethylene dichloride, added to the fuel in an amount between one and ten gram-atoms of chlorine per gram-atom of metal in the coloring agent, is suitable for this purpose. Alternatively, a flame retardant of the chlorinated paraffin type may be compounded with the shell material in an amount corresponding to 1–10 gram-atoms of chlorine per gram-atom of the metal in the coloring agent.

Two additional advantages arise from the particular characteristics of the present invention. First, because the fuel, except for the burning surface, is contained within a shell, and because the fuel evolves into a gas directly from the solid state, no dripping occurs. Second, because the fuel must burn very cleanly to avoid coloring the flame yellow, little, if any, residue remains. What remains of the shell can be tapped into a wastebasket, and any other residues are washable with water, because, unlike ordinary candle wax, the large number of oxygen atoms in the fuel of the present invention promote dispersion or dissolution in water.

Such candles, while not producible by the ordinary methods used for manufacturing candles, are easily prepared by conventional processes used for the components of the present invention. For example, a shell material of the desired composition can be specified to, and purchased from, any one of a number of plastic compounding firms. It can then be formed in an extruder or injection molding machine, for example, into the desired shape, with a desired surface texture and any design or embossment, to produce a shell (and consequently the appearance of a candle body) exhibiting any desired shape, color, and design that the shell is capable of accepting and maintaining, even during the burning process. The fuel can be mixed in like fashion and then packed into the shell up to the top.

The resulting candle can be used for decorative or ceremonial purposes; for example, red and green candles can be used for Christmas; blue and white candles for Jewish holidays; various colors for birthdays; and so on. In fact, appropriate flame colorant distribution can allow multicolored flames. For example, the left half of the flame could be green, and the right half red, not possible for the ordinary candle flame, or even a colored-flame candle with a wick. Moreover, the candle of the present invention can be made into shapes not possible for ordinary wax candles. For example, although birthday candles are presently available with designs of the arithmetic digits 0 to 9, each is essentially a square of wax with a wick in the top center, and a numeric design on the face. The candle of the present invention can be formed, and will burn properly, in the shape of the numeral with no excess material.

The following examples are provided only for illustrative purposes, but they are not intended to limit the scope of the invention.

EXAMPLE 1

A shell was prepared from 20% alumina trihydrate, manufactured by Solem Industries under the name Micral 942, in polypropylene, manufactured by Himont, Inc. under the designation 7823, by placing the resin between two 12"×12" plates in a hydraulic press at 50,000 lb and 400° F. A square approximately 4"×3"×1/32" was cut from the cooled sheet, placed on aluminum foil in an oven, and heated again to 400° F. Lithium chloride powder was sprinkled on the surface, and the softened sheet was rolled up almost completely around a length of ⅞" diameter copper pipe. The rolled sheet was allowed to cool, the aluminum foil peeled away, and the plastic reheated until soft again. It was then rolled farther around the pipe, overlapping and sealing the edges.

The tubular shell, now about 1" diameter, and 3" high, was filled with a fuel (63.9 g) made from paraformaldehyde (50 parts by weight) that had been powdered and mixed into a paste with a solution of trioxane (5 parts) and ethylene glycol (9 parts).

The resulting candle was placed in a candle holder and ignited with a match, requiring about 30 seconds to catch fire. It burned with an attractive red flame at the rate of about 15 minutes per inch for a period of about 45 minutes.

EXAMPLE 2

A candle shell was prepared by the method described in Example 1, except that a rectangular piece about 4"×2¼" was used, and the lithium chloride was omitted. The tube, ⅞" diameter ×2¼" high, was packed with a fuel (20 g) of powdered paraformaldehyde (17.5 parts), trioxane (1.8 parts), ethyl alcohol (7.1 parts), and boric acid (0.5 parts) that had been heated and mixed into a paste.

The resulting candle was placed in a candle holder and ignited with a match, requiring about 30 seconds to catch fire. It burned with an attractive green flame at the rate of about 20 minutes per inch for a period of about 50 minutes

EXAMPLE 3

The shell material was prepared from polypropylene (32 g) and silicone (8 g resin and 0.87 g curing agent) in the mixing chamber of a torque rheometer. Cupric chloride (1.06 g) was added, turning brown, likely from oxidation. The resin was formed into a shell about ⅞" diameter and 2⅞" high, and packed with the fuel described in Example 1, except that ethylene dichloride (5.5 g) was added to the fuel (44.5 g), and the shell thickness tapered from about 0.04" to about 0.05". The candle burned with an attractive blue flame at an initial rate of about 80 minutes per inch, which slowed steadily as the flame encountered the continually increasing shell thickness. The candle was extinguished after 89 minutes, leaving about 2⅛". It should be noted that the blue color was much more intense than the pale blue of a similar candle lacking any flame coloring agent.

A similar candle from which the ethylene dichloride had been omitted burned with a green flame.

What is claimed is:

1. A candle capable of producing a colored flame which consists of
   1) a protective shell consisting of 70–90% of a non-charring thermoplastic polyolefin;
   2) a fire retardant added to said shell in the amount of 10–30% of the weight of said shell;
   3) a fuel contained within the protective shell comprising 70–100% by weight of at least one polyoxymethylene, a binder and a solvent, said binder and said solvent being in the amount of 0–30% and 0–20% based respectively on the weight of said fuel;
   4) a non-toxic non-explosive flame coloring agent which is a member selected from the group consisting of inorganic salts, inorganic oxides, carboxylic acid salts and organic complexes of a metal whic is Li, B, Na, Ca, Cu, K, Sr, In, or Ba, said organic complexes containing only carbon-oxygen unsaturation, said coloring agent being in the amount of 1–70% by weight of said protective shell or said fuel.

2. The candle according to claim 1 wherein said polyolefin is polypropylene.

3. The candle according to claim 1 wherein said polyoxymethylene is prilled or powdered paraformaldehyde.

4. The candle according to claim 3 wherein said binder is trioxane or ethylene glycol.

5. The candle according to claim 1 wherein said fire retardant is alumina trihydrate, a silicone elastomer; magnesium hydroxide, or magnesium carbonate/calcium carbonate.

6. The candle according to claim 3 wherein the binder is dimethyl oxalate or a polyethylene glycol of at least 1450 average molecular weight.

7. The candle according to claim 1 wherein said solvent is methanol, ethanol, ethylene glycol, or a polyethylene glycol of less than 400 average molecular weight, and said solvent is used to spread said binder.

8. The candle according to claim 3 wherein the paraformaldehyde has an average molecular weight of about 450 and a melting range of about 110°–160° C.

9. The candle according to claim 1 wherein said coloring agent is an acetylacetone complex of at least one of Li, B, Na, Ca, Cu, K, Sr, In and Ba.

10. The candle according to claim 1 wherein a co-coloring agent is added to said coloring agent to change the hue or increase the intensity of the color of the flame.

11. The candle according to claim 10 wherein the co-coloring agent is a chlorinated paraffin.

12. The candle according to claim 10 wherein the co-coloring agent is dichloroethane.

13. The candle according to claim 1 wherein said fire retardant slows the burning rate of said fuel to 1 inch/-15–20 minutes.

14. The candle according to claim 3 wherein the paraformaldehyde is 76% to 80% of the total weight of the fuel.

15. The candle according to claim 3 wherein the binder is 6% to 9% of the total weight of the fuel.

16. The candle according to claim 3 wherein the solvent is 12% to 16% of the total weight of the fuel.

17. The candle according to claim 1 wherein the fire retardant is 15% to 20% of the total weight of the shell.

18. The candle according to claim 11 wherein the candle has a cylindrical shape, is 12 inches long and a diameter of ⅞ of an inch and the shell has a thickness of 0.03 inch to 0.04 inch.

19. The candle according to claim 1 wherein the coloring agent is present in the shell in an amount of 10% to 70% of the total shell weight.

20. The candle according to claim 10 wherein the co-coloring agent is a chlorine-containing compound in an amount sufficient to supply between 1 and 10 gram-atoms of chlorine per gram-atom of said metal in the coloring agent.

* * * * *